United States Patent [19]

Vierkötter

[11] Patent Number: 4,637,746

[45] Date of Patent: Jan. 20, 1987

[54] DISPENSER FOR A TWO-COMPONENT ADHESIVE

[75] Inventor: Peter Vierkötter, Leverkusen, Fed. Rep. of Germany

[73] Assignee: Henkel Kommanditgesellschaft auf Aktien, Duesseldorf, Fed. Rep. of Germany

[21] Appl. No.: 260,940

[22] Filed: May 6, 1981

Related U.S. Application Data

[63] Continuation-in-part of Ser. No. 16,549, Mar. 1, 1979, abandoned.

[30] Foreign Application Priority Data

Mar. 10, 1978 [DE] Fed. Rep. of Germany ..... 2810408

[51] Int. Cl.[4] ..... B05C 17/00; A45D 40/24; B67D 5/42

[52] U.S. Cl. ..... 401/82; 401/19; 401/29; 401/35; 401/98; 401/176; 222/137; 222/326; 222/386

[58] Field of Search ..... 401/82–84, 401/17, 19, 29, 30, 31, 32, 34, 35, 44, 47, 99, 171, 176, 179, 98, 177; 132/79 C; 222/135, 136, 137, 386, 391, 94, 326

[56] References Cited

U.S. PATENT DOCUMENTS

| | | | |
|---|---|---|---|
| 1,576,567 | 3/1926 | Buhl-Bonanno | 132/79 C |
| 1,931,079 | 10/1933 | Mitchel | 401/82 |
| 1,933,538 | 11/1933 | Brazelton | 401/29 |
| 2,122,523 | 7/1938 | Hulskamp | 222/326 X |
| 3,166,221 | 1/1965 | Nielson | 222/386 X |
| 3,920,156 | 11/1975 | Hicks | 222/326 X |

FOREIGN PATENT DOCUMENTS

| | | | |
|---|---|---|---|
| 869548 | 7/1949 | Fed. Rep. of Germany | 401/31 |
| 2136709 | 2/1973 | Fed. Rep. of Germany | 222/137 |

*Primary Examiner*—Steven A. Bratlie
*Attorney, Agent, or Firm*—Ernest G. Szoke; Nelson Littell, Jr.

[57] ABSTRACT

A dispensing container for multicomponent adhesives and other materials in which correct proportions, amount or ratios of two or more ingredients may be dispensed from a container while keeping the two or more ingredients from mixing together prior to application of the adhesive ingredients to the work to be glued or during closure of the container after application of the adhesive ingredients to the work. The container preferably comprises a hollow right angle prism divided by a slidable, self-supporting partition or partitions parallel to the longitudinal axis of the prism and pistons or plungers attached to the slidable partition or partitions and a slidable lug operating through a slot in the container wall to slide the partition with the attached plungers upwardly or downwardly to push the adhesive ingredients out of the container or return them into the container.

2 Claims, 2 Drawing Figures

FIG. 1
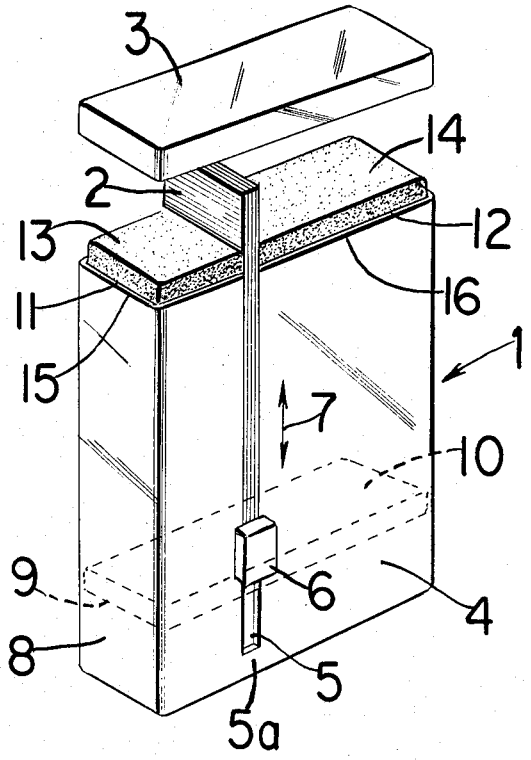
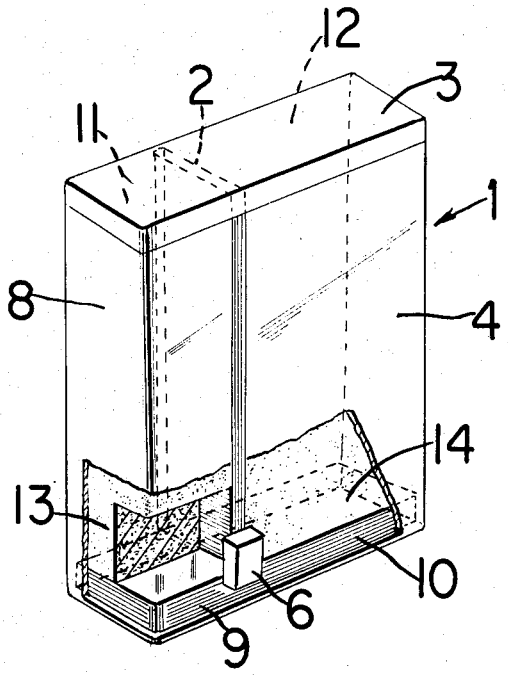
FIG. 2

DISPENSER FOR A TWO-COMPONENT ADHESIVE

This application is a continuation-in-part of my copending patent application Ser. No. 016,549, filed Mar. 1, 1979, and now abandoned.

BACKGROUND OF THE INVENTION

This invention relates to a dispenser for two-component adhesives in which two chambers are provided, one each to receive one of the components in the mixing ratio corresponding to the volumetric ratio of the components in the final adhesive to be applied on the surfaces to be joined together. The chamber bottoms are designed as pistons or plungers for simultaneously pushing out the contents of the chambers in the volumetric ratio desired in the final mixed adhesive.

In the prior art containers for two separate component adhesives, double chambers, a tube and chamber, double tubes, two tubes or double bottles are used and the components are removed and mixed by means of a spatula. In most cases the components are only proportioned visually and in two-component adhesive mixtures the optimum adhesion is in most cases not obtained, or if obtained, only by accident.

Double containers with two juxtaposed cylinders and pistons, where the volumetric ratio of the cylinder chambers corresponds to the desired mixing ratio of the components, in which the two components can be squeezed out simultaneously by means of the pistons from the cylinders, have been tried without satisfactory results. In these double component containers the pistons are provided, for example, with two spindles which are in engagement each with one of the pistons and with each other through gear wheel connections. The contents of the two cylinders can thereby be squeezed out simultaneously by turning the gear wheels and, therefore, by advancing the pistons into the cylinders by the desired amount. This permits forced dosage of the two components, but the design of the containers with the two separate cylindrical chambers pistons, gears, etc., is so costly and complicated that they are not economically practical and, in addition, there is always the possibility that the residual amounts of the components in the separate cylinders will be mixed accidentally at the head of the containers when the components are squeezed out.

OBJECTS OF THE INVENTION

One of the objects of this invention is to provide a less elaborate and less expensive container for two-component adhesives which will permit accurate proportioning or dosage of each component with simple handling of the container.

Another object is to provide a container for two-component adhesives which is easy to operate and less susceptible to trouble and disproportionate mixing of the two components.

Another object is to provide a two-component dispenser for adhesives in which the two dispensing chambers are in one container designed as an elongated rectangular prism separated into two chambers by a slidable, self-supporting partition parallel to the longitudinal axis of the prism, and displaceable in the direction of this axis and having pistons attached to and moving with said partition to push the contents of said chambers out of chambers in the proportionate amounts required to produce the best adhesive mixture.

Other objects and advantages will appear as this description proceeds.

THE DRAWINGS

FIG. 1 shows an open container with the self-supporting partition lifted.

FIG. 2 shows a closed container with parts broken away to show its interior construction.

DESCRIPTION OF THE INVENTION

The solution of the problem in a dispenser of the above-indicated type consists in that the chambers are separated, in a container formed as a right prism by dividing its interior by a self-supporting partition or partitions extending parallel to the longitudinal axis of the prism and displaceable in the direction of this axis, that the pistons or plungers forming the bottom surfaces of the chambers are attached laterally on the bottom end of the partition facing the bottom of the container, and that the partition has at least one lug operated from the outside of the container to displace the partition and the pistons connected thereto in the direction parallel to the longitudinal axis of the prism. The container according to the invention preferably has the form of a rectangular block. The partition extends perpendicularly to the wide lateral surfaces of the block, as well as parallel to its narrow lateral surfaces. The lug attached on the partition, which is provided to displace the partition in the direction of the longitudinal axis of the prism, projects on the outside of the container through a slot provided in one of the wide lateral surfaces of the container.

More particularly, the present invention involves a dispenser for dispensing several components in a volumetric mixing ratio with at least two chambers each provided to receive one of the components in the mixing ratio corresponding to the volumetric ratio of the components, where the chamber bottoms are provided with slidable pistons for simultaneously pushing the contents of the chambers out of the dispenser, characterized in that the dispenser is a hollow right prism divided by a self-supporting partition or partitions of the length of said chambers and extending parallel to the longitudinal axis of the prism and displaceable in the direction of this axis and extending between the walls of said chambers whereby accidental mixing of said components in the chambers is prevented, that pistons forming the bottom surfaces of the chambers are laterally attached to the bottom end of the partition or partitions facing the bottom of the dispenser, that stripping edges are present at the top of said chambers, and that the at least one partition has a lug operated from the outside of the dispenser to displace the partition or partitions in a direction parallel to the longitudinal axis of the prism.

The invention thus provides a container whose interior is divided into two compartments in a very simple way by a displaceable self-supporting partition provided with two lateral pistons. The division can be made in the exact mixing ratio desired for the two components, for example, resin and hardener. Displacement of the partition provided with two lateral pistons in the container by means of the outside lug results in forcing the desired amount of each ingredient out of the container in a constant mixing ratio.

The improvement over the previous proposals is that the partition and the pistons attached laterally on its bottom form a single integral part of the dispenser so that elaborate means for the simultaneous operation of the pistons are not necessary.

The product or the individual components can be stripped from the top plane of the container by means of a spatula or other spreading device. The self-supporting partition prevents accidental mixing of the residual amounts in the container when the product is withdrawn.

After the product has been removed, the self-supporting partition and also the residual amount of the two components can be drawn again into the container by downward movement of the partition and the container closed with a cover.

Additional details of the invention will be described more fully on the basis of the schematic representation of the preferred embodiment shown in the drawings in which FIG. 1 shows an open container with the self-supporting partition lifted. FIG. 2 shows a closed container with parts broken away to show its interior construction.

The dispenser according to the embodiment in FIGS. 1 and 2 consists of a hollow block-shaped container 1, a self-supporting partition 2 and a cover 3. In one large lateral surface 4, a slot 5 is provided through which a lug 6 connected with partition 2 projects to the outside. The slot 5 does not extend through the back wall and the front wall of container 1 is held together by the integral connection 5*a* at the base of the slot 5. By displacing lug 6 in the direction of arrow 7, partition 2 extending parallel to the narrow lateral surfaces 8 may be moved upward or downward.

As illustrated in FIGS. 1 and 2, pistons 9 and 10 are attached laterally on the bottom end of partition 2 and form the bottom of the two chambers 11 and 12 of container 1 separated by partition 2. When partition 2 is operated by displacing lug 6 upward in the direction of arrow 7, the contents of the two chambers 11 and 12, namely, the first component 13 and the second component 14 are pushed simultaneously upward and out of the container. Part of the contents of the container 1 are pushed above stripping edges 15, 16 and can be removed with a spatula and applied to the work to be glued. Since self-supporting partition 2 is at the same time extended from container 1 from which components 13 and 14 are moved out, accidental mixing of the two components 13 and 14, particularly of the residual amounts in chambers 11 and 12, is prevented by the self-supporting partition 2. The self-supporting partition 2 should have sufficient rigidity in order that it is not displaced when the contents are removed with a spatula.

After the product has been removed from container 1, partition 2 can be moved down into the container again by means of lug 6, and the contents of the two chambers 11 and 12 are as a rule pulled down into the container. When partition 2 has been completely pushed down, cover 3 can be attached as shown in FIG. 2.

While I have illustrated and described a specific embodiment of my invention for dispensing proportionate amounts of a two-component mixture, it will be obvious that containers for dispensing proportionate amounts of three, four or more component mixtures can be made by providing two, three or more partitions therein, that the lateral end walls of said container may be curved instead of rectangular and that various other modification and changes from the embodiment shown may be made within the spirit of this invention and scope of the claims thereto.

I claim:

1. Dispenser for dispensing two components in a volumetric mixing ration with two chambers each provided to receive one of the components in the mixing ratio corresponding to the volumetric ratio of the components, where the chamber bottoms are provided with slidable pistons for simultaneously pushing the contents of the chambers out of the dispenser, characterized in that the dispenser is a hollow right prism divided by a self-supporting partition of the length of said chambers and extending parallel to the longitudinal axis of the prism and displaceable in the direction of this axis and extending between the walls of said chambers whereby accidental mixing of said components in the chambers is prevented, that pistons forming the bottom surfaces of the chambers are laterally attached to the bottom end of the partition facing the bottom of the dispenser, that stripping edges are present at the top of said chambers, that a slot is provided in one wall of the dispenser along one edge of the partition, and that the partition has a lug directly attached therewith, said lug projecting to the outside through said slot to move the partition and attached pistons up and down in the dispenser and being operated from the outside of the dispenser to displace the partition in a direction parallel to the longitudinal axis of the prism.

2. Dispenser according to claim 1, characterized in that the dispenser has the form of a hollow block.

* * * * *